US012285053B1

(12) United States Patent
Cheng et al.

(10) Patent No.: US 12,285,053 B1
(45) Date of Patent: Apr. 29, 2025

(54) ATOMIZING DEVICE PREVENTING OIL LEAKAGE

(71) Applicant: Shenzhen Woody Vapes Technology Co., Ltd., Guangdong (CN)

(72) Inventors: Ying Cheng, Guangdong (CN); Zhaohui Zhang, Guangdong (CN); Lijun Chen, Guangdong (CN); Chengxin Jia, Guangdong (CN)

(73) Assignee: Shenzhen Woody Vapes Technology Co., Ltd., Shenzhen (CN)

( * ) Notice: Subject to any disclaimer, the term of this patent is extended or adjusted under 35 U.S.C. 154(b) by 0 days.

(21) Appl. No.: 18/882,820

(22) Filed: Sep. 12, 2024

(30) Foreign Application Priority Data

Jan. 26, 2024 (CN) ..... 202420208149.8

(51) Int. Cl.

| | |
|---|---|
| ***A24F 40/44*** | (2020.01) |
| ***A24F 40/10*** | (2020.01) |
| ***A24F 40/46*** | (2020.01) |
| ***A24F 40/485*** | (2020.01) |
| ***A24F 40/51*** | (2020.01) |
| ***A24F 40/95*** | (2020.01) |

(52) U.S. Cl.
CPC ..... *A24F 40/485* (2020.01); *A24F 40/10* (2020.01); *A24F 40/46* (2020.01); *A24F 40/51* (2020.01); *A24F 40/95* (2020.01)

(58) Field of Classification Search
CPC ..... A24F 40/44; A24F 40/46; A24F 40/40; A24F 40/10
See application file for complete search history.

(56) References Cited

U.S. PATENT DOCUMENTS

2023/0380501 A1* 11/2023 Zhou ..... A24F 40/42

FOREIGN PATENT DOCUMENTS

| | | | |
|---|---|---|---|
| CN | 217184835 U | * | 8/2022 |
| CN | 218921626 U | * | 4/2023 |
| CN | 116711884 A | * | 9/2023 |

* cited by examiner

*Primary Examiner* — Hae Moon Hyeon

(57) ABSTRACT

Disclosed is an atomizing device, including: a housing, in which a first installation space and a host compartment are formed, the first installation space being spaced apart from the host compartment; an oil storage structure disposed in the first installation space and containing an oil storage chamber for storing oil; an atomizing tube disposed in the oil storage structure, in which an oil inlet is disposed at an air inlet end of the atomizing tube; an atomizing core disposed in the atomizing tube and spaced from the air inlet end of the atomizing tube in a longitudinal direction of the oil storage structure; and an oil guide member disposed between the atomizing tube and the atomizing core, in which the oil guide member is connected with the atomizing core, and is in communication with the oil inlet.

20 Claims, 6 Drawing Sheets

ATOMIZING DEVICE PREVENTING OIL LEAKAGE

CROSS-REFERENCE TO RELATED APPLICATIONS

This application claims the benefit of priority of Chinese Patent Application No. 202420208149.8, filed on Jan. 26, 2024, the contents of which are incorporated by reference as if fully set forth herein in their entirety.

TECHNICAL FIELD

This disclosure relates to the field of atomization, and in particular, to an atomizing device.

BACKGROUND

Atomizing devices generally includes an atomizer and electronic elements such as a gas flow transducer (for example, microphone sensor) and a circuit board. The atomizer can heat an oil solution to be atomized and output a mixture of the heated oil solution and air to a user. In the conventional atomizing device, the atomizer is disposed at the same position as the electronic elements such as the microphone sensor and the circuit board, and if leakage of the oil solution occurs in the atomizer, it may affect the reliability of the electronic elements.

SUMMARY

Embodiments of the present disclosure provide an atomizing device, which can solve a problem of oil leakage of the existing atomizing device.

According to embodiments of the present disclosure, there is provided an atomizing device, including: a housing, in which a first installation space and a host compartment are formed, the first installation space being spaced apart from the host compartment; an oil storage structure disposed in the first installation space and containing an oil storage chamber for storing oil; an atomizing tube disposed in the oil storage structure, wherein an oil inlet is disposed at an air inlet end of the atomizing tube; an atomizing core disposed in the atomizing tube and spaced from the air inlet end of the atomizing tube in a longitudinal direction of the oil storage structure; and an oil guide member disposed between the atomizing tube and the atomizing core, wherein the oil guide member is connected with the atomizing core, and is in communication with the oil storage chamber through the oil inlet.

The atomizing tube is sleeved on the oil guide member and accommodated in the oil storage structure, and an oil inlet is formed at the air inlet end of the atomizing tube for communicating the oil storage chamber with the oil guide member.

BRIEF DESCRIPTION OF THE DRAWINGS

In order to illustrate the technical solutions in the embodiments of the present disclosure clearly, the accompanying drawings will be referred below to briefly explain the embodiments of the present disclosure. It is apparent that the drawings described below are merely some of the embodiments of the present disclosure, and other drawings can be made from these drawings without involving any inventive effort to those skilled in the art.

For understanding of the present disclosure and its advantages, reference will now be made to the accompanying drawings. In the following description, like reference numerals refer to like parts.

LIST OF REFERENCE NUMERALS

Figure 1:
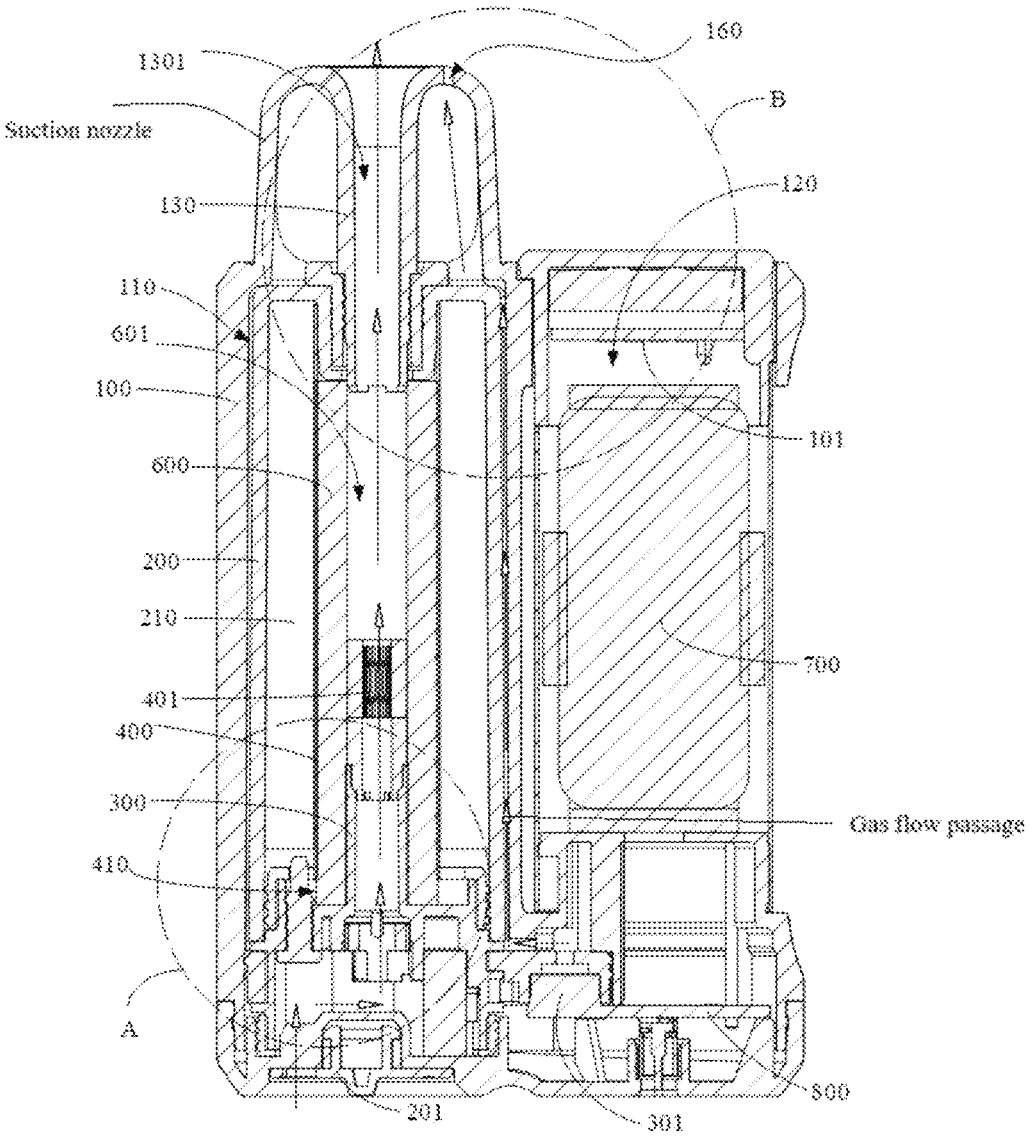
FIG. 1 is a schematic sectional view of an atomizing device according to some embodiments of the present disclosure.

List of reference numerals:

| No.: | Components: | No.: | Components: |
|---|---|---|---|
| 100 | Housing | 500 | Base |
| 110 | First installation space | 600 | Oil guide member |
| 120 | Host compartment | 601 | First mist outlet passage |
| 130 | Mist outlet tube | 700 | Battery |
| 1301 | Second mist outlet passage | 800 | Control assembly |
| 140 | Display opening | 910 | First separator |
| 150 | Air inlet | 920 | Second separator |
| 160 | Air hole | 101 | Display screen |
| 200 | Oil storage structure | 201 | Turntable |
| 210 | Oil storage chamber | 202 | Through hole |
| 300 | Atomizing bracket | 301 | Microphone sensor |
| 310 | Air inlet passage | 401 | Atomizing core |
| 400 | Atomizing tube | | |
| 410 | Oil inlet | | |

DETAILED DESCRIPTION OF EMBODIMENTS

Embodiments of the present disclosure will be described with reference to the accompanying drawings. It will be apparent that the described embodiments are only part, and not all of the embodiments of the present disclosure. All other embodiments provided by a person skilled in the art based on the embodiments in the present disclosure, without involving any inventive effort, are within the scope of the present disclosure.

Embodiments of the present disclosure provide an atomizing device, which solves a problem of oil leakage of an existing atomizing device. The description of the atomizing device is made in detail below in conjunction with the accompanying drawings.

Referring to FIG. 1, the atomizing device according to some embodiments of the present disclosure includes a housing 100, an oil storage structure 200, an atomizing bracket 300, and an atomizing tube 400. A first installation space 110 is formed in the housing 100. In addition, a host compartment 120 may also be formed in the housing. The first installation space 110 is spaced apart from the host compartment 120. In some embodiments, the housing 100 may be machined to form the host compartment 120 and the first installation space 110. That is, the walls of the host compartment 120 and the first installation space 110 may be formed of the housing separately. In some embodiments, the walls of the host compartment 120 and the walls of the first installation space 110 may be integrally formed.

A battery 700 and a control assembly 800 may be disposed in the host compartment 120. The battery is electrically connected to the control assembly, so that power can be supplied to the control assembly 800 and other structures such as a heating wire of an atomizing core. The control assembly 800 is configured to control the fogging.

In the embodiments shown in FIG. 1, the first installation space 110 and the host compartment 120 may be disposed side by side. That is, the host compartment 120 is disposed on a side of the first installation space 110 that is located in the lateral direction of the atomizing core 401. However, in other embodiments, the first installation space 110 and the host compartment 120 may also be arranged in the longitudinal direction of the atomizing core 401.

The oil storage structure 200 is disposed in the first installation space 110. An oil storage chamber 210 may be disposed in the oil storage structure 200 for storing oil. The oil storage structure 200 may be provided integrally with the housing 100, or may be provided separately from the housing as in the embodiments of FIG. 1. When integrated, the assembly process can be simplified. When provided separately, replacement of the oil storage bin can be facilitated. Both of the above embodiments are applicable in practical applications.

The atomizing core 401 is connected to an oil guide member. The atomizing core is mounted in the atomizing tube 400 and spaced apart from with an air inlet end of the atomizing tube 400 in the longitudinal direction of the oil storage structure. An oil inlet is disposed at the air inlet end. The oil inlet is spaced apart from the atomizing core in the longitudinal direction of the oil storage structure, thereby achieving better anti-oil leakage effect of the atomizing device. When using the atomizing device, the user needs to actively inhale gas, and a negative pressure is formed in the atomizing tube to draw mist out of the atomizing device. Due to the negative pressure in the atomizing tube, an oil solution to be atomized, known as e-liquid or "juice", is prone to break through the surface of the atomizing core and cause leakage. At this time, the atomizing device tends to be in an upright position, and the oil inlet is at a position lower in the gravity direction than the atomizing core (because the user tends to inhale with their head down). Thus, by providing the oil inlet at the air inlet end of the atomizing tube, and designing the oil inlet spaced apart from the atomizing core in the longitudinal direction of the oil storage structure, it is possible to enable the oil inlet to be at a position lower than the atomizing core. As a result, when the oil solution needs to reach the atomizing core through the oil flowing passage, it is necessary to resist the action of gravity of the oil solution, that is, to move a certain height in the reverse direction of gravity. Therefore, gravity can offset part of the push force generated by the oil pressure in the oil storage chamber, thereby avoiding oil leakage in the above-mentioned state where oil leakage is most likely to occur. Therefore, the anti-oil effect of the atomizing device provided by the embodiments of the disclosure is better.

In some embodiments, the atomizing device may further include a base 500. A bottom end of the oil storage structure 200 may be sealed by the base. The atomizing tube 400 may be received within the oil storage structure 200. Further, the atomizing bracket 300 is protruded from the base, and the atomizing tube 400 is sleeved on the atomizing bracket 300. In some embodiments, the atomizing bracket 300 may be a hollow tubular convex structure protruding from the base, which may extend through the bottom of the base. The atomizing tube 400 may be made from a metallic material, such as stainless steel, aluminum, and iron, or other materials capable of withstanding high temperature of the atomizing reaction. In some embodiments, the atomizing tube 400 and the housing 100 may be integrally formed, which is simple in process and beautiful in shape. The atomizing core 401 is mounted on the atomizing bracket 300 and configured to heat the oil solution into an aerosol. The atomizing bracket 300 can support the atomizing core 401. An outer diameter of the atomizing bracket 300 is less than an inner diameter of the atomizing tube 400 so that the atomizing tube 400 can be sleeved on the atomizing bracket 300.

The atomizing device according to some embodiments of the present disclosure further includes an oil guide member 600. A space is formed between the atomizing bracket 300 and the atomizing tube 400, and the oil guide member 600 can be installed the space between the atomizing bracket 300 and the atomizing tube 400. The oil guide member 600 has a property of adsorbing and storing the oil solution, and may be made from cotton, fiber, porous body, ceramic, or other materials, preferably polyester fiber, so as to facilitate introduction of oil into the atomizing core. In actual installation, the oil guide member 600 may be sleeved on the atomizing bracket 300, and then the atomizing tube 400 may be sleeved on the oil guide member 600, so that the oil guide member 600 are installed between the atomizing bracket 300 and the atomizing tube 400. The oil guide member 600 is disposed in the atomizing tube 400, and two ends of the oil guide member 600 extend toward opposite ends of the atomizing tube 400, namely, the top end and the bottom end, respectively. The bottom end of the oil guide member 600 is in communication with the oil inlet. The atomizing core is connected to the oil guide member. The oil guide member may be sleeved on the atomizing core and connected to the atomizing core, so that the oil solution in the oil guide member flows into the atomizing core, at where the oil solution is heated and atomized to convert into an aerosol. In some embodiments, the length of the atomizing bracket 300 may be less than that of the atomizing tube 400. The oil guide member 600 may be of a cylindrical shape. An inner diameter of the oil guide member 600 is larger than the outer diameter of the atomizing bracket 300, and an outer diameter of the oil guide member 600 is less than the inner diameter of the atomizing tube 400.

Figure 2:
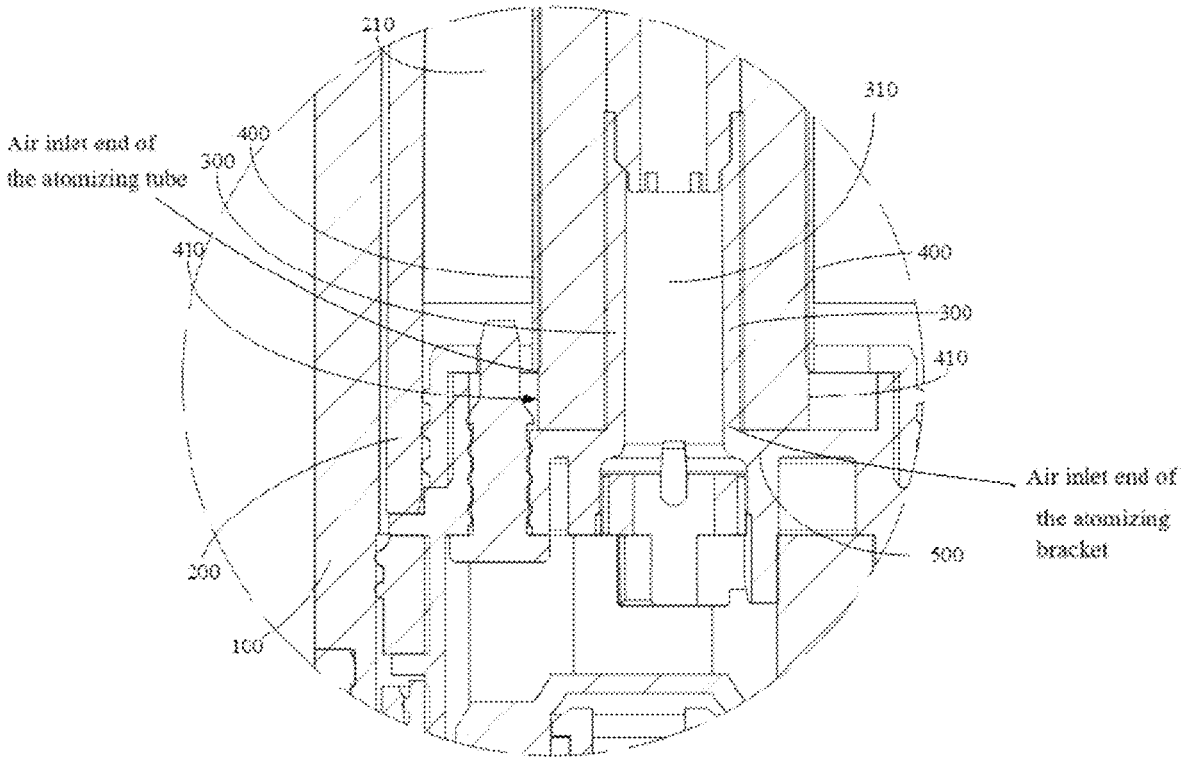
FIG. 2 is an enlarged view of part A in FIG. 1.

In some embodiments of the present disclosure, the atomizing bracket 300 may be of a hollow cylindrical convex structure protruding from the base 500. The atomizing bracket 300 may extend through the bottom of the base 500. An end of the atomizing bracket 300 adjacent to the base 500 is defined as an air inlet end of the atomizing bracket 300. Referring to FIG. 2, an inner hollow of the atomizing bracket 300 can serve as an air inlet passage 310 for an atomizing reaction. The air inlet passage 310 can communicate with an atomizing site in the atomizing core and an outer atmosphere, so that the external gas can enter the atomizing core through the bottom of the base, the air inlet end of the atomizing bracket 300, and the air inlet passage 310 to involve in the atomizing reaction, and thus an aerosol is generated. Then, the aerosol passes through a mist outlet passage and is inhaled by a user.

Referring to FIG. 1, the mist outlet passage includes a first mist outlet passage 601 and a second mist outlet passage 1301. The length of the atomizing bracket is less than the length of the atomizing tube so that the first mist outlet passage is formed at an end of the oil guide member far away from the air inlet end of the atomizing bracket. The first mist outlet passage 601 may be a passage provided inside the oil storage structure 200 and communicating with the air inlet passage. The second mist outlet passage may be a passage provided outside the oil storage structure 200 and communicating with the first mist outlet passage. The second mist outlet passage is communicated with the outside. Since the oil guide member 600 is cylindrical in shape and has a hollow structure inside, the mist outlet passage may be formed in the hollow structure inside the oil guide member 600. The arrangement can reduce manufacturing materials and costs.

The oil inlet 410 is disposed on a side wall of the atomizing tube 400 and at the air inlet end of the atomizing tube. The atomizing tube is further provided with an air outlet end. It can be readily understood that the external gas enters the atomizing tube through the air inlet end of the atomizing tube, and is mixed with the atomized oil solution to form an aerosol inside the atomizing tube, and then flows out of the atomizing tube through the air outlet end of the atomizing tube. The air inlet end of the atomizing tube is disposed close to the air inlet end of the atomizing bracket. That is, the oil inlet 410 is provided at a side of the atomizing tube close to the base 500. The oil inlet 410 is spaced apart from the atomizing core in longitudinal direction of the atomizing bracket. The oil inlet 410 communicates with the oil storage chamber 210 of the oil storage structure 200 so that the oil solution in the oil storage chamber 210 can enter the atomizing tube 400 through the oil inlet 410.

The oil inlet 410 may be a via hole or an opening provided in the side wall of the atomizing tube 400, and is provided at a portion near the bottom end of the atomizing tube 400. When the oil inlet 410 is provided at the bottom of the atomizing tube 400, the oil inlet 410 may be designed in the form of a notch. When the oil solution in the oil storage structure enters the atomizing tube 400 through the oil inlet, the unit feed volume of the oil solution may be related to the diameter of the oil inlet, which may be designed according to the actual requirements. A plurality of liquid inlets may be provided at the peripheral side of the atomizing tube 40, so that the contact area between the oil inlets 410 and the oil solution is larger, thereby facilitating absorption of the oil solution. When the atomizing device is in an inclined state (i.e., the longitudinal direction of the atomizing bracket 300 is angled with the gravity direction) and the oil solution in the oil storage chamber 210 is low, it is possible to ensure that the oil solution contacts the oil guide member 600 through the oil inlets 410, thereby avoiding shortage of the oil solution supplied to the atomizing core 401. The oil inlet(s) 410 may also be located at the bottom of the atomizing tube, which is in view of the user's usual use state. That is, when in use, the mist-out direction in FIG. 1 tends to be opposite to the direction of gravity, so that the oil solution may accumulate in the direction of gravity, i.e., toward the bottom of the oil storage chamber 210 in FIG. 1. The oil inlet 410 is provided at this position to absorb as much oil solution as possible, thereby reducing the frequency of adding oil and facilitating use.

In the embodiments of the present disclosure, the oil solution in the oil storage chamber 210 contacts the oil guide member 600 through the oil inlet 410 and moves toward the side facing away from the oil inlet 410 under the action of capillary phenomenon in the oil guide member 600. The atomizing core may be installed at the end of the oil guide member 600 facing away from the oil inlet so that the atomizing core is in close contact with the oil guide member 600 so that the atomizing core can atomize the oil solution to generate an aerosol. The atomizing core is disposed at a higher position than the oil inlet by a distance in the longitudinal direction of the atomizing tube toward the top end. The distance can be designed according to the actual requirements, and is not limited herein.

Referring to FIG. 1, the flow direction of the gas in the atomizing bracket 300 (and the mist outlet tube 130) is indicated by hollow arrows. The flow direction is opposite to the direction of gravity in the usual use state of the atomizing device. Therefore, it is to be noted that the oil inlet is disposed on the side of the atomizing core 401 near the air inlet end of the atomizing bracket 300, and is spaced from the atomizing core 401 in the longitudinal direction of the atomizing bracket 300, so that the position of the oil inlet 410 is lower than that of the atomizing core 401, thereby forcing the oil solution to overcome gravity and move upwardly within the oil guide member 600 as it enters the atomizing core 401 from the oil guide member 600. The force against gravity may be provided by the oil pressure in the oil storage chamber 210 of the oil storage structure 200, and gravity may offset part of the push force generated by the oil pressure in the oil storage chamber 210 on the oil solution, making it less likely that the oil solution breaks through the radial inner side of the atomizing core 401, thereby presenting from entering the mist outlet passage and oil leakage. Therefore, the atomizing device according to the embodiments of the present disclosure improves the anti-oil leakage compared with the prior art.

According to the atomizing device in some embodiments of the present disclosure, a first installation space 110 is spaced apart from the host compartment 120, and the oil storage chamber 210 and the mist outlet passage can be completely isolated (i.e., without material exchange) from the host compartment 120, so as to prevent the oil solution or atomized gas from entering the host compartment 120 and contaminating elements mounted in the host compartment 120. Electronic elements such as the control assembly 800 and the battery 700 may be provided in the host compartment 120, so that the electronic elements can be protected. It is to be noted that the host compartment 120 and the first installation space 110 may communicate with each other. A microphone sensor 301 is disposed on the control assembly 800 for sensing the inhaling intensity from the user, and the heating efficiency (i.e., the atomizing efficiency) of the atomizing core 401 is adapted to the inhaling intensity of the user. To this end, it is possible to communicate the setting environment of the microphone sensor 301 with the negative pressure environment in the oral cavity of the user. Referring to the implementation shown in FIG. 1, an air hole 160 may be provided on the housing. The air hole 160 communicates with the negative pressure environment in the oral cavity of the user and the microphone sensor 301 through a gas flow passage indicated by hollow arrows (beside the mist outlet passage, from the microphone sensor 301, through the outer wall of the oil storage structure 200, to the air hole 160). In this case, the microphone sensor 301 is connected to the user's oral cavity using another air passage independent of the mist outlet passage, thereby ensuring that the oil solution and atomized gas are not easy to enter the host compartment 120 and solving the problem of oil leakage of the atomizing device.

Figure 3:
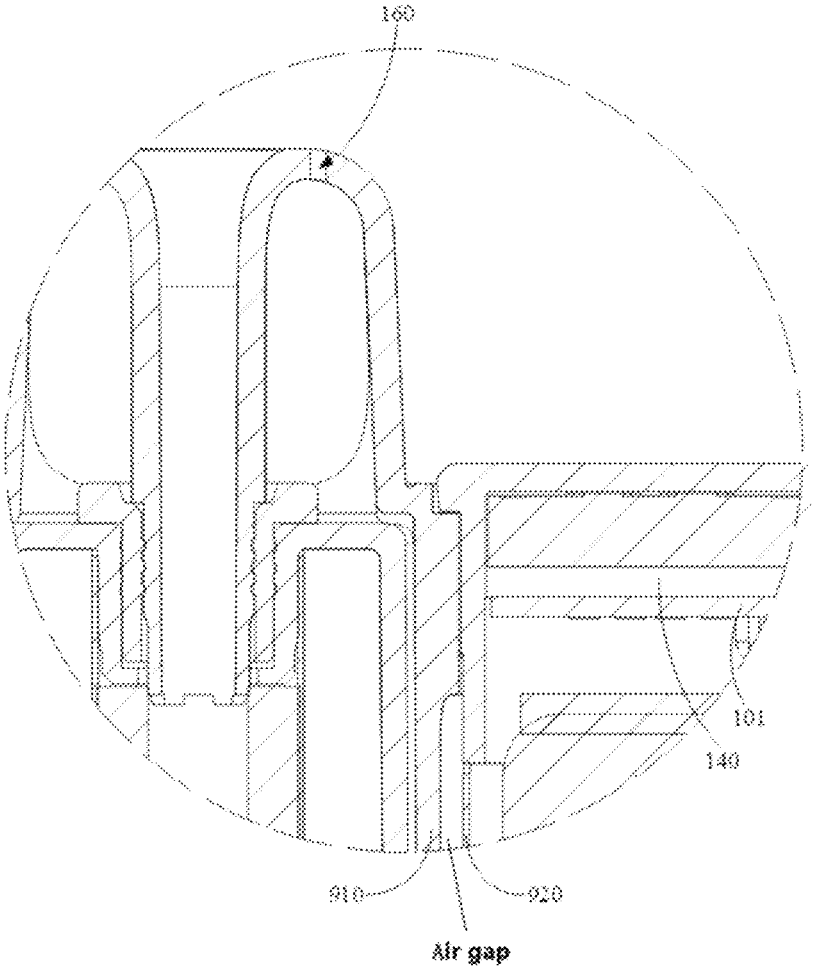
FIG. 3 is an enlarged view of part B in FIG. 1.

Referring to FIG. 3, in some embodiments, the atomizing device further includes a first separator 910 and a second separator 920. The first installation space 110 is formed by the first separator 910 and a part of the housing 100, and the host compartment 120 is formed by the second separator 920 and a part of the housing 100. In the lateral direction of the atomizing tube 400, the first separator 910 and the second separator 920 are spaced apart from each other, and the first separator 910 and the second separator 920 are both disposed between the host compartment 120 and the first installation space 110. The first separator 910 and the second separator 920 are spaced apart from each other so that there is an air gap between the host compartment 120 and the first installation space 110, and the air gap can be filled with air as the user moves the atomizing device, and thus heat transfer between the host compartment 120 and the first installation space 110 is less. By this arrangement, it avoids the heat generated by the atomizing core 401 from warming the battery 700 in the host compartment 120, and also avoids the battery 700 in the host compartment 120 from heating the oil solution, thereby reducing the speed of deterioration of the oil. Thus, the battery 700 and the oil solution can be protected in the above embodiments. In the actual product, the first separator 910, the second separator 920, and the housing 100 may be integrally formed. The first separator 910, the second separator 920, and the housing 100 together form the outer case of the atomizing device, thereby simplifying the manufacturing process and improving the appearance. In other embodiments, the first separator 910, the second separator 920, and the housing 100 may be joined by welding, bonding, or the like.

Referring to FIG. 1, the first mist outlet passage is formed in the oil guide member. The atomizing device further includes a suction nozzle. A mist outlet tube 130 is formed inside the suction nozzle. The second mist outlet passage 1301 is formed inside the mist outlet tube 130. The second mist outlet passage 1301 communicates with the first mist outlet passage 601 and the outside. In some embodiments, the suction nozzle may be integrally formed with the housing 100, or may be a part of the housing. Specifically, the mist outlet tube 130 includes an air inlet end of the mist outlet tube 130 and an air outlet end of the mist outlet tube 130. The air inlet end of the mist outlet tube 130 communicates with the mist outlet passage, and the air outlet end of the mist outlet tube 130 communicates with the outside of the atomizing device. The mist outlet tube 130 provides the second mist outlet passage 1301 outside the oil storage structure 200, thereby reducing the volume of the structure used for forming the mist outlet passage in the oil storage structure 200, providing more oil storage space for the oil storage chamber 210, and increasing the oil storage capacity. It will be readily appreciated that the mist outlet passage may include two portions, one of which is the mist outlet passage within the oil storage structure 200 and may be formed by the oil guide member 600, and the other of which is the mist outlet passage outside the oil storage structure 200 and may be formed by the suction nozzle.

Figure 4:
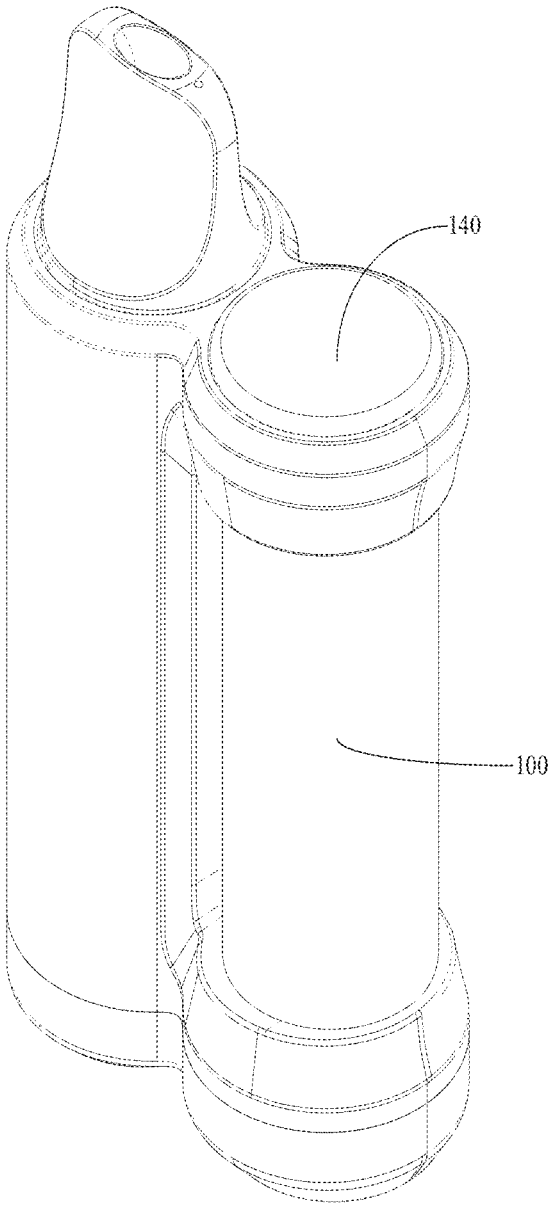
FIG. 4 is a schematic three-dimensional structure of an atomizing device of FIG. 1.

Referring to FIG. 3, in some embodiments, a display screen 101 is further provided in the host compartment 120. The display screen 101 is electrically connected to the control assembly 800, so that the display screen 101 may display parameter information of the atomizing device sensed by the control assembly 800, such as parameters of an electric quantity, an oil volume, or aging of the atomizing core 401, on the display surface thereof for reading by a user. In addition, a display opening 140 is disposed on the housing 100, and the display surface of the display screen 101 is provided toward the display opening 140 so that the user can view information displayed on the display screen 101 through the display opening 140. As shown in FIG. 4, the display opening 140 is covered with a transparent protective cover to protect the display screen 101. The protective cover may, of course, not be provided, thereby reducing the cost.

Figure 6:
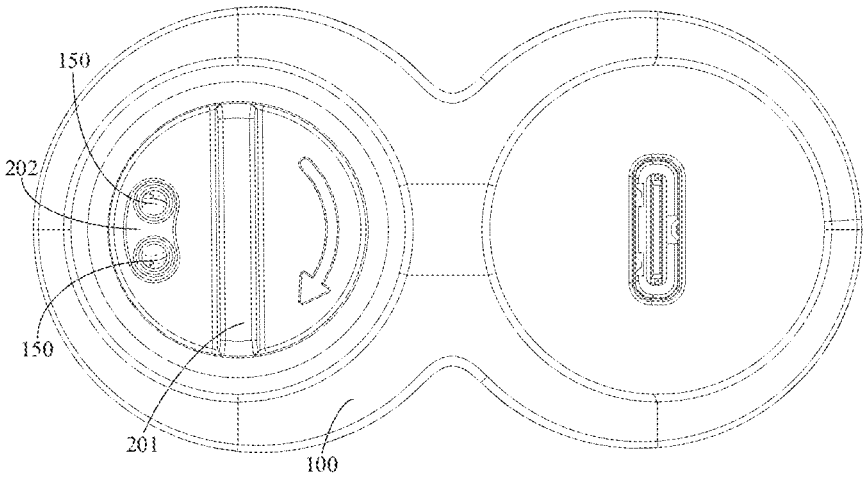
FIG. 6 is a schematic bottom view of an atomizing device of FIG. 1 with a turntable in a first position.

Referring to FIG. 6, in some embodiments, one or more air inlets 150 are provided in the wall of the housing 100 that is used for forming the first installation space 110. The air inlet 150 communicates with the air inlet end of the atomizing bracket 300. An air-entering regulating mechanism is disposed on the air inlet 150 for regulating the ventilation area of the air inlet 150. The size of the ventilation area of the air inlet 150 may be related to the amount of gas flow when the same negative pressure is applied. Alternatively, it is possible to vary the suction resistance to suit different needs of users for the suction resistance. For example, when a large suction resistance is required, the ventilation area of the air inlet 150 may be reduced using the air-entering regulating mechanism; and when a small suction resistance is required, the ventilation area may be increased. The air-entering regulating mechanism may be a valve with an adjustable opening mounted on the wall that is used for forming the air inlet 150. The structure of the valve belongs to the prior art and is therefore not shown in the drawings.

Figure 7:
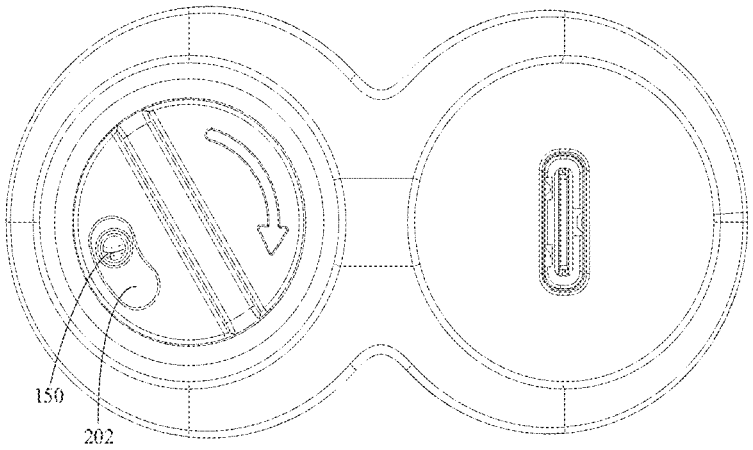
FIG. 7 is a schematic bottom view of an atomizing device of FIG. 1 with a turntable in a second position.

Referring to FIGS. 1, 6, and 7, in some embodiments, the air-entering regulating mechanism includes a turntable 201 rotatably connected to the housing 100. A through hole 202 is disposed on the turntable 201. When the turntable 201 is rotated to different angles, the through-hole 202 may have different overlap area with the air inlets 150. Referring to FIGS. 6 and 7, the different rotational positions of the turntable 201 are shown, indicating that the turntable 201 can change the relative positional relationship between the through hole 202 and the air inlet 150 by rotation, thereby changing the overlap area of the through hole 202 and the air inlet 150. The overlap area is the final effective ventilation area, thereby adjusting the suction resistance. This solution can be implemented without a valve and is therefore less expensive.

Referring to FIG. 6, in some embodiments, a plurality of air inlets 150 are provided. The air inlets 150 are spaced apart in the circumferential direction of the turntable 201. The total intake area of the plurality of air inlets 150 is larger than that of the single air inlet 150, so that the adjustment of the suction resistance can be made in a larger range. Further, the plurality of air inlets 150 are spaced apart so as to avoid concentration of the air inlets 150 in one position, and if the air inlets 150 are disposed in a concentrated manner, the strength of the chamber wall may be weakened, and thus the air inlets 150 are spaced apart from each other to ensure that the housing of the atomizing device is of high strength.

Figure 5:
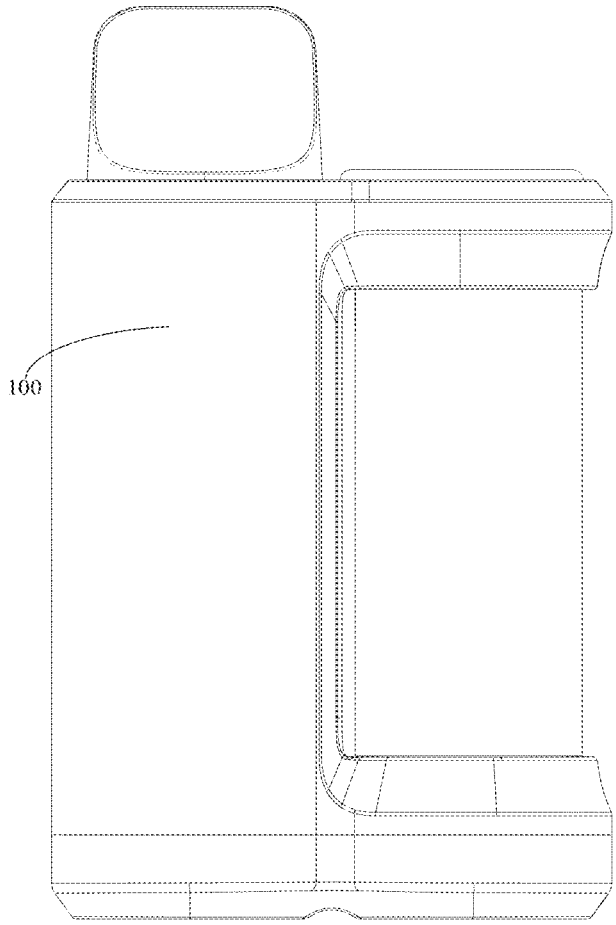
FIG. 5 is a schematic front view of an atomizing device of FIG. 1.

Referring to FIGS. 1 and 5, in some embodiments, the shell wall of the housing 100 for forming the first installation space 110 and the oil storage structure 200 comprise a transparent material. Thus, the user can directly observe the oil solution in the oil storage chamber 210 through the housing 100 and the oil storage structure 200 in the first installation space 110, thereby judging whether the amount of the oil solution is sufficient or not and whether another oil solution needs to be added. Thus, it may facilitate a user to replenish the oil solution in the oil storage chamber 210 in a time.

In some embodiments, the atomizing tube and the oil storage structure are integrally formed, thereby simplifying the production process, reducing costs, and being more aesthetically pleasing.

According to the atomizing device in the embodiments of the present disclosure, the first installation space is provided at an interval from the host compartment, and the oil storage chamber and the mist outlet passage can be isolated from the host compartment to prevent the oil solution or atomized gas from entering the host compartment and from polluting parts installed in the host compartment, thereby solving the problem of poor anti-oil leakage effect of the existing atomizing device. The atomizing core is connected to the oil guide member, and the atomizing tube is sleeved on the oil guide member and is accommodated in the oil storage structure. The oil inlet is used for communicating the oil storage chamber with the oil guide member, so that the oil solution in the oil storage chamber of the oil storage structure can enter the oil guide member through the oil inlet, then is supplied to the atomizing core by the oil guide member, and then converted into an aerosol after being heated by the atomizing core. In the atomizing device according to the embodiments of the present disclosure, the atomizing core is connected to the oil guide member, and the atomizing core is installed in the atomizing tube and is arranged at intervals with the air inlet end of the atomizing tube in the longitudinal direction of the oil storage structure. The oil inlet is disposed at the air inlet end, so that the oil inlet and the atomizing core are arranged at intervals in the longitudinal direction of the oil storage structure, which is beneficial to achieve better anti-oil leakage of the atomizing device. When using the atomizing device, the user needs to actively inhale gas, and a negative pressure is formed in the atomizing tube to draw mist out of the atomizing device. Due to the negative pressure in the atomizing tube, the oil solution to be atomized is prone to break through the surface of the atomizing core and cause leakage. At this time, the atomizing device tends to be in an upright position, and the oil inlet is at a position lower in the gravity direction than the atomizing core (because the user tends to inhale with their head down). Thus, by providing the oil inlet at the air inlet end of the atomizing tube, and designing the oil inlet spaced apart from the atomizing core in the longitudinal direction of the oil storage structure, it is possible to enable the oil inlet to be at a position lower than the atomizing core. As a result, when the oil solution needs to reach the atomizing core through the oil flowing passage, it is necessary to resist the action of gravity of the oil solution, that is, to move a certain height in the reverse direction of gravity. Therefore, gravity can offset part of the push force generated by the oil pressure in the oil storage chamber, thereby avoiding oil leakage in the above-mentioned state where oil leakage is most likely to occur. Therefore, the anti-oil effect of the atomizing device provided by the embodiments of the disclosure is better.

In the above embodiments, the description of each embodiment has its own emphasis, and parts not described in detail in a certain embodiment may be referred to the related description of other embodiments.

In the description of the present disclosure, the terms "first" and "second" are used for descriptive purposes only and are not to be construed as expressing or implying relative importance or implying the number of indicated technical features. Therefore, a feature defined as "first" or "second" may expressly or implicitly include one or more features.

Embodiments of the present disclosure provide description with reference to the atomizing device in detail. Specific embodiments are used to illustrate the principles and implementation of the present disclosure. The description of the above embodiments is merely provided to assist in understanding the method of the present disclosure and the core concepts thereof. Variations may be made to those skilled in the art in both specific implementation and application scope in accordance with the teachings of the present disclosure. In summary, the contents of this specification should not be construed as a limitation of the present disclosure.

What is claimed is:

1. An atomizing device comprising:

a housing, in which a first installation space and a host compartment are formed, the first installation space being spaced apart from the host compartment, an oil storage structure disposed in the first installation space and containing an oil storage chamber for storing oil, an atomizing tube disposed in the oil storage structure, wherein an oil inlet is disposed at an air inlet end of the atomizing tube, an atomizing core disposed in the atomizing tube and spaced from the air inlet end of the atomizing tube in a longitudinal direction of the oil storage structure, an oil guide member disposed between the atomizing tube and the atomizing core, wherein the oil guide member is connected with the atomizing core, and is in communication with the oil storage chamber through the oil inlet, and an atomizing bracket configured to abut against an inner wall of the oil guide member.

2. The atomizing device according to claim 1, further comprising a first separator and a second separator, wherein the first installation space is formed by the first separator and a portion of the housing, the host compartment is formed by the second separator and a portion of the housing, the first separator and the second separator are spaced apart from each other in a lateral direction of the atomizing tube, and the first separator and the second separator are both disposed between the first installation space and the host compartment.

3. The atomizing device according to claim 2, wherein an air gap is formed between the first separator and the second separator and filled with air to reduce heat transfer between the host compartment and the first installation space.

4. The atomizing device according to claim 2, wherein the first separator and the second separator are integrally formed with the housing.

5. The atomizing device according to claim 1, wherein the atomizing core is mounted on the atomizing bracket, the oil guide member is sleeved on the atomizing core, a length of the atomizing bracket is less than that of the atomizing tube, so that a first mist outlet passage is formed at an end of the oil guide member far away from an air inlet end of the atomizing bracket, and the atomizing device further comprises a suction nozzle, a second mist outlet passage is formed in the suction nozzle, and the second mist outlet passage is in communication with the first mist outlet passage; and the second mist outlet passage is in communicated with the outside.

6. The atomizing device according to claim 5, wherein the suction nozzle is integrally formed with the housing.

7. The atomizing device according to claim 5, further comprising a base, wherein a bottom end of the oil storage structure is sealed by the base, and the atomizing bracket is protruded from the base.

8. The atomizing device according to claim 7, wherein the atomizing bracket is a hollow convex structure and is configured to communicate with the base, and an air inlet passage is formed inside the atomizing bracket to communicate with the atomizing core and an outside atmosphere.

9. The atomizing device according to claim 5, wherein the oil guide member is installed between the atomizing bracket and the atomizing tube, and a bottom of the oil guide member is connected to the oil inlet.

10. The atomizing device according to claim 9, wherein the oil inlet is disposed on an end of the atomizing tube close to the base, and is spaced apart from the atomizing core along an axial direction of the atomizing bracket.

11. The atomizing device according to claim 10, wherein the oil inlet is positioned at a distance lower along a gravity direction than the atomizing core.

12. The atomizing device according to claim 5, wherein one or more air inlets are disposed on a wall of the housing that is used for forming the first installation space; the air inlets are in communication with the air inlet end of the atomizing bracket; and an air-entering regulating mechanism is disposed at the air inlets for adjusting ventilation area of the air inlets.

13. The atomizing device according to claim 12, wherein the air-entering regulating mechanism comprises a turntable rotatably connected to the housing; a through hole is disposed on the turntable; and the through hole has different overlap areas with the air inlets when the turntable is rotated to different angles.

14. The atomizing device according to claim 13, wherein the air inlets are multiple and disposed at intervals in a circumferential direction of the turntable.

15. The atomizing device according to claim 5, wherein the host compartment comprises a control assembly and a battery electrically connected to the control assembly and the atomizing core for power supply.

16. The atomizing device according to claim 15, wherein an air hole is provided on an end of the housing close to the suction nozzle, the control assembly comprises a microphone sensor, and the microphone sensor is in communication with the air hole through a gas flow passage formed outside the oil storage structure.

17. The atomizing device according to claim 1, wherein the oil inlet is a via hole, an opening or a notch.

18. The atomizing device according to claim 1, wherein a display screen is disposed in the host compartment, a display opening is formed in the housing, and a display surface of the display screen is provided toward the display opening.

19. The atomizing device according to claim 1, wherein both of a wall of the housing that is used for forming the first installation space and the oil storage structure comprise a transparent material; and/or, the atomizing tube and the oil storage structure are integrally formed.

20. The atomizing device according to claim 1, wherein the atomizing tube is integrally formed with the housing.

* * * * *